United States Patent [19]

Dat

[11] Patent Number: 4,771,716

[45] Date of Patent: Sep. 20, 1988

[54] PLEASURE BOAT STRUCTURE

[76] Inventor: Frédéric J. J. Dat, 4, Allée d'Aquitaine, 77176 Savigny-Le-Temple, France

[21] Appl. No.: 905,314

[22] PCT Filed: Dec. 9, 1985

[86] PCT No.: PCT/FR85/00354

§ 371 Date: Aug. 13, 1986

§ 102(e) Date: Aug. 13, 1986

[87] PCT Pub. No.: WO86/03722

PCT Pub. Date: Jul. 3, 1986

[30] Foreign Application Priority Data

Dec. 14, 1984 [FR] France ..... 84 19939
Jul. 24, 1985 [FR] France ..... 85 11651

[51] Int. Cl.[4] ..... B63B 1/00

[52] U.S. Cl. ..... 114/61; 114/39.1; 114/123

[58] Field of Search ..... 114/61, 39, 123, 283

[56] References Cited

U.S. PATENT DOCUMENTS 2,238,464 4/1941 Fletcher ..... 114/39
2,351,542 6/1944 Paull ..... 114/39
3,112,725 12/1963 Malrose ..... 114/39

FOREIGN PATENT DOCUMENTS 922065 3/1963 United Kingdom ..... 114/123

*Primary Examiner*—Sherman D. Basinger
*Assistant Examiner*—Jesus D. Sotelo
*Attorney, Agent, or Firm*—Birch, Stewart, Kolasch, & Birch

[57] ABSTRACT

A boat structure including an oblong central body, two pontoons, two longitudinal lateral arms of which a first of their extremities is integral with said body by first attachment members and two second and third linking members of the two other second extremities of the arms are attached, respectively, to one of the two pontoons. The body includes a beam comprising two parts abutting one against the other along a junction surface, a first relatively short part substantially in the shape of the arc of a circle with a first value R1 for the radius of curvature and a second part longer than the first part, in the shape substantially of the arc of a circle with a second value R2 for the radius of curvature significantly greater than the first value R1.

28 Claims, 7 Drawing Sheets

PLEASURE BOAT STRUCTURE

The present invention concerns boats of the pleasure craft type, more particularly sailboats, for example, trimarans.

DESCRIPTION OF THE BACKGROUND ART

Sailing is not just a leisure activity, but also a sport for the majority of its practitioners. For high-level sporting activity in the strict sense, there are of course many high-performance boats reserved for the elite. In fact, those boats are very expensive and thus, in principle, accessible only to very few people. In addition to these high-performance boats, there are not only sailboats which make it possible to gain experience in sailing techniques, but also to move about. Between these two categories there is an intermediate category where initiates can practice their leisure activity and also obtain satisfactory performances. They need to possess boats which provide relatively high performance, but unfortunately, the price that they must pay for such a boat is prohibitive, which means that most of them are unable to practice their favorite sport.

SUMMARY OF THE INVENTION

The aim of the present invention is thus to provide a structure for a sailboat, like a trimaran, providing satisfactory sporting performances while being of very simple design permitting easy transport, and convenient dismantling and reassembly. This structure, because of its advantages, makes possible a production cost significantly lower than that of boats having or capable of attaining comparable performance.

More exactly, the aim of the present invention is a boat structure comprising an elongated central body, two pontoons, two longitudinal lateral arms of which one of their extremities is made integral with said body by the first fastening means and the second and third linking means of the two other extremities of said arms with respectively the two said pontoons. A boat with a structure of this type has been described in patent GB No. 922.065 (Welman).

The boat structure in accordance with the invention is characterized by the fact that said body is composed of a beam comprising two parts abutting by a junction surface, a first relatively short part substantially in the shape of the arc of a circle with a first curve value R1, a second part longer than the first part, substantially in the shape of the arc of a circle with a second value R2 with a radius of curvature significantly greater than the first value R1.

In accordance with another characteristic of the invention, the structure is also characterized by the fact that the two said arms are composed of a curved shaft situated in a first plane substantially perpendicular to a second plane containing said beam, said first plane passing in the vicinity of said junction surface of the two said parts, the lengths of the two parts of said shaft situated on either side of said second plane being substantially equal, these two said parts of said shaft comprising the two said arms.

In accordance with another characteristic of the present invention, said structure is also characterized by the fact that it includes a mast step pivoting in said second plane around an axis situated substantially in proximity to said shaft and to the locking means of said mast step in a position determined in relation to said beam.

In accordance with another characteristic of the present invention, said structure is also characterized by the fact that said pontoons are constituted by a first body comprising at least one median portion substantially cylindrical of revolution, a sleeve situated on said median portion with a cross-section substantially complementary to that of said median portion, in such a way as to be able to pivot around that median portion, a foil mounted to operate in conjunction with said sleeve and the means to control the pivoting of said sleeve.

In accordance with another characteristic of the present invention, said structure is characterized by the fact that it comprises, in association with at least one of said elongated central bodies and two arms, preplaced means for attaching navigation element and at least one navigation element operating in conjunction with said attachment means.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other characteristics and advantages of the present invention will be found in the following description made in reference to the annexed drawings, which are provided as an illustration but are in no way limiting, in which.

DETAILED DESCRIPTION OF THE PREFERRED EMBODIMENTS

Figure 1:
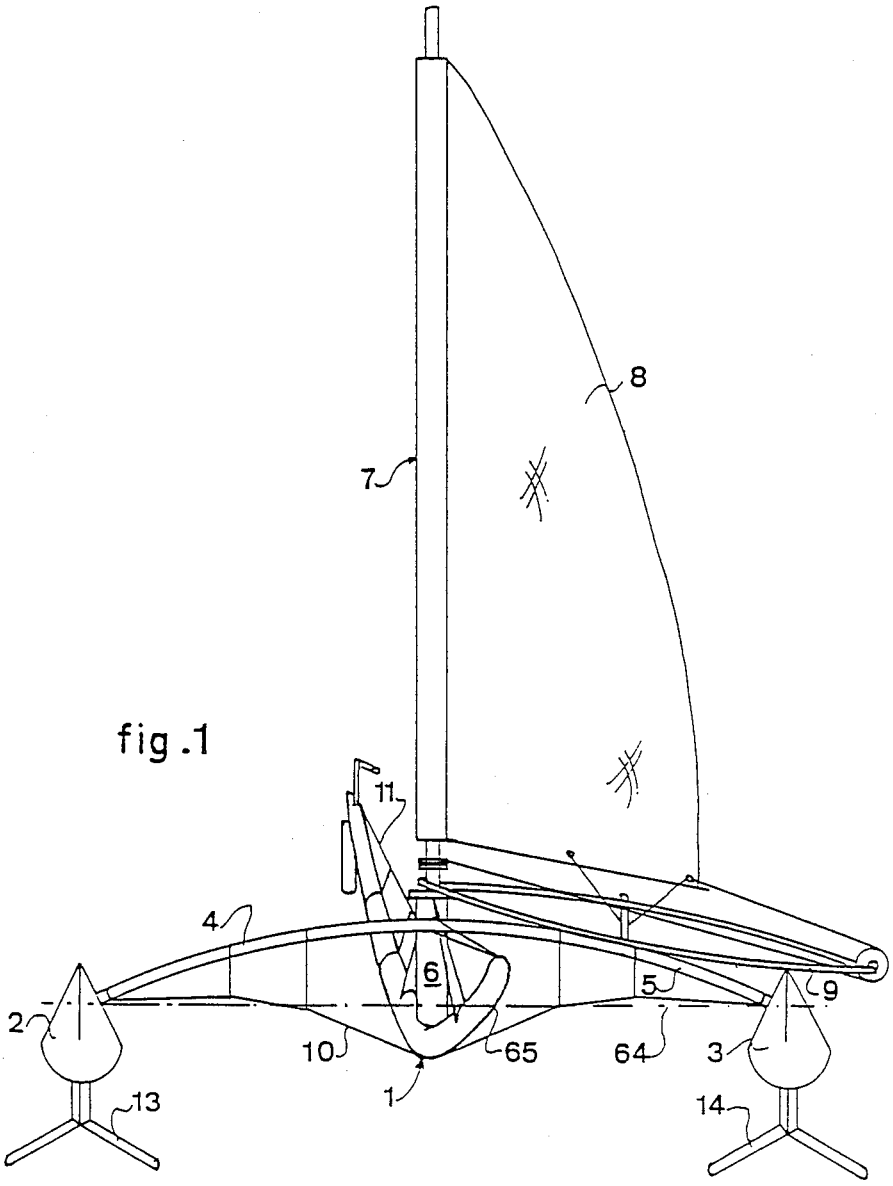
FIGS. 1 and 2 represent respectively, a perspective and partially side view and a view from above of an embodiment of a boat structure in accordance with the invention, of the trimaran type with a central part bordered on either side by two pontoons connected to the central part by two arms.

It is first pointed out that all of the figures represent one and the same embodiment of a boat structure in accordance with the invention. Thus, the same reference numerals refer to the same elements and, for better understanding of the description, it will be useful to refer to the figure in which the element referred to appears most clearly.

Figure 2:
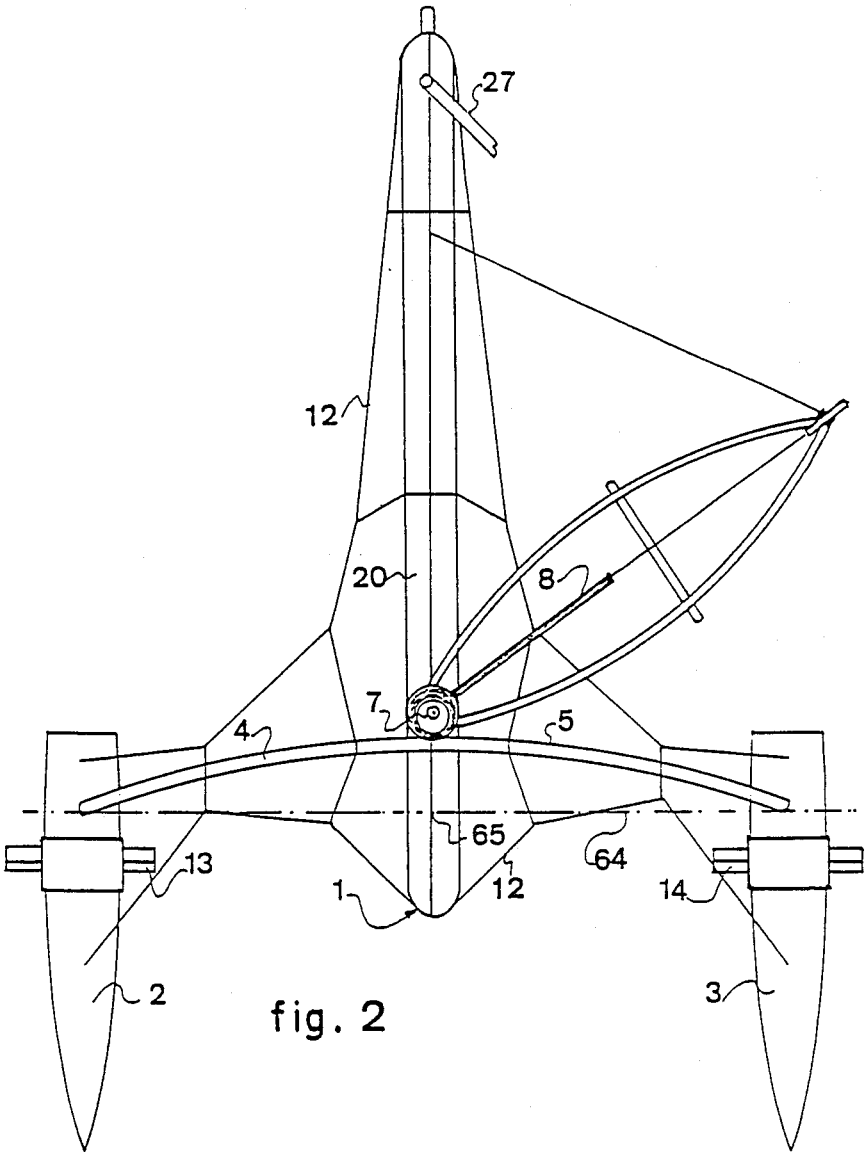

Referring more particularly to FIGS. 1 and 2, which show, in two different views, one in perspective and slightly from the side and the other from above, an embodiment of a boat structure of the trimaran type, comprising a central elongated body 1 bordered on either side by two pontoons 2 and 3. These two pontoons are connected to central body 1, respectively by two arms 4 and 5 which are joined at one point on the two pontoons 2 and 3 and by linking means to the central body 1. With the above-described elements are associated a mast step 6 in which a mast 7 may be positioned supporting at least one sail 8. This sail 8 can be extended, for example by means of boom 9, such as the element known as a wishbone. These structural elements are reinforced by tension means 10 and 11 which make it possible to give them the necessary rigidity, while still providing them with a certain flexibility so that they can absorb the stress or shocks they will undergo when such a boat moves over the surface of the water.

It will be noted in addition, referring more particularly to FIG. 2, that other tension means 12 go from one extremity to the other of central body 1 passing by each extremity of arms 4 and 5. These tension means which thus link each extremity of the structural elements of the invention make possible the close integration of all of these elements and increase the rigidity of the unit without hampering its flexibility.

Foils 13 and 14 can be attached respectively to the two pontoons 2 and 3.

All of these elements as mentioned above will be described in greater detail in reference to the other figures annexed to the present description.

Figure 3A:
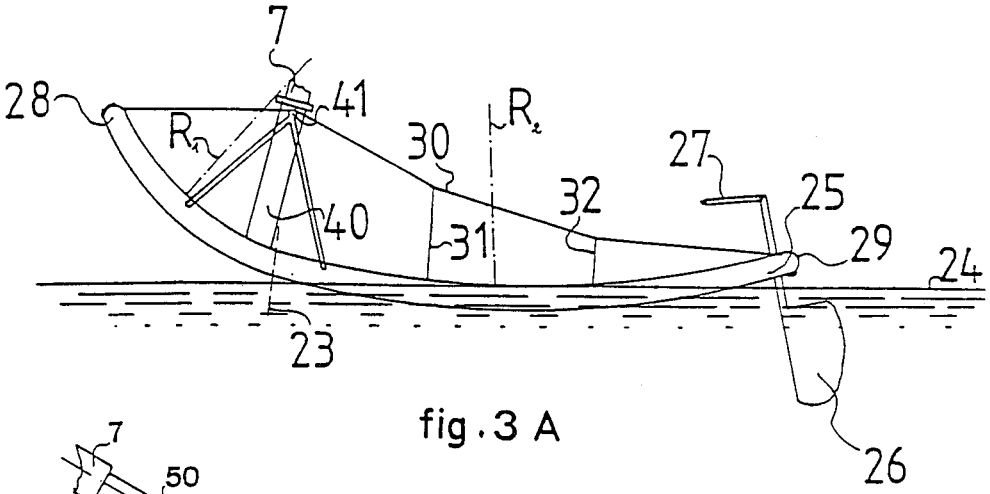
FIGS. 3A and 3B show in greater detail the central part of the embodiment in accordance with FIGS. 1 and 2.
Figure 3B:
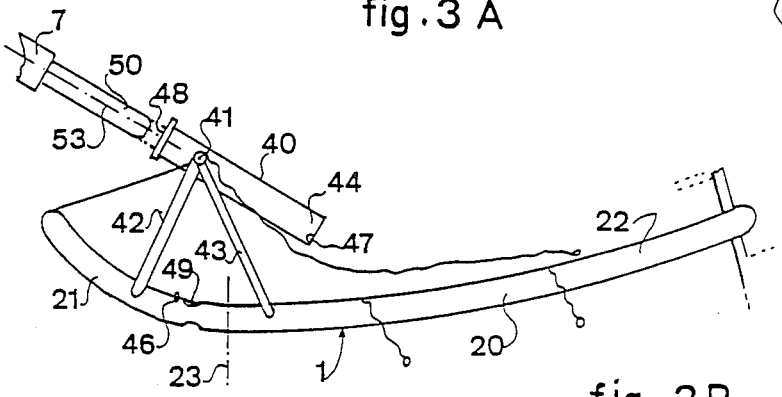

Referring more particularly to FIGS. 1, 3A and 3B of the present description, these represent the part of central body 1 as mentioned above. This central body 1 is essentially made up of a longitudinal beam 20 comprising at least two parts 21 and 22. These two parts 21 and 22 abut along a first junction surface substantially defined as 23. These two parts 21 and 22 are substantially in the shape of the arc of a circle of which the first part 21 has a radius of curvature, for example R1, with a certain relatively low value, whereas the second part 22, which is also in the general shape of the arc of a circle, has a radius of curvature R2 whose value is significantly higher than the value of R1 defined above.

This central body is intended to comprise a part of the structure allowing a certain flotation. Thus, the beam is preferably tubular with a circular, oval or triangular cross-section, and is closed on its two extremities to permit flotation. For example, in FIG. 3A, the flotation is shown in relation to water level 24 on which such a boat structure is intended to move.

In addition, extremity 25 of the second longer part of the two parts making up the beam may comprise a rudder 26 mounted pivoting on that extremity 25. It may be controlled by any type of arm such as that illustrated schematically as 27. However, a rudder is preferred of the type to be described hereinafter in reference to FIGS. 7A and 7B.

To provide a certain rigidity to this beam which tends, due to its natural elasticity, to slacken, the two beam extremities 28 and 29 are linked by a traction cable 30 enabling a certain force to be exercised on each extremity. This cable 30 can be linked by a number of sub-tension cables such as 31 and 32 distributed along the length of the beam, to provide a certain rigidity along the length of cable 30 and to keep it from deforming or moving out of its plane.

Generally speaking, the first part 21 having the smaller radius of curvature R1 will comprise the front or bow of the boat, while the longer part will in fact form the resistance which will be more or less in contact with water surface 24 as a function of the speed reached by the boat. At high speeds, the boat will be supported on the water by means only of its pontoons 2 and 3.

In proximity to the junction surface 23 as defined above, a mast step element 40 is located which is pivotally mounted about an axis 41 preferably perpendicular to the plane in which is contained the curved axis of beam 20. The support bearings of this axis 41 are positioned in relation to beam 20 by means, for example, of two braces 42, 43, forming a support to enable the mast step element 40 to pivot around that axis 41 which must remain in a relatively fixed position in relation to beam 20. The rotation of this mast step 40 as described above obviously provides the advantage of making it possible to make mast 7 operate with the other elements of the structure, in an easy fashion. The righting of the mast by rotation to its normal position is thus much easier, without the use of this boat requiring outside help.

In addition, this mast step element must comprise means for locking its extremity 44 in relation to beam 20, in such a way that, when the mast is positioned in the mast step 40, as shown in FIG. 3A, it will be in the normal position of a mast in such a type of boat. These locking means are simply illustrated, particularly in FIG. 3B, by a ratchet 46 able to operate in conjunction with a corresponding notch 47 located in extremity 44 of the mast step element 40.

Figure 4:
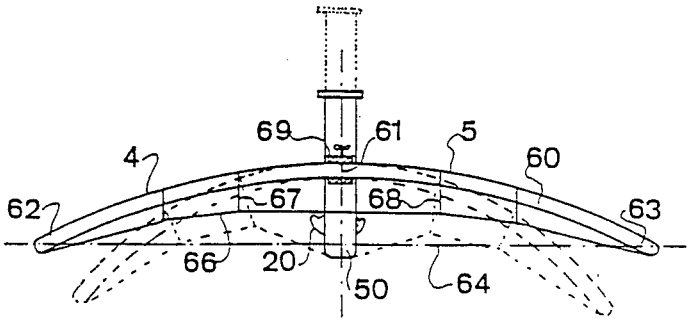
FIG. 4 represents a view of the two arms of the embodiment in accordance with FIGS. 1 and 2.

This mast step element 40 is preferably made up of a tubular element comprising a hollow recess, open on at least one extremity 48, and suitable for receiving extremity 50 of mast 7 which can thus be positioned simply by placing it in the recess located in the mast step 40. In a preferred embodiment, the mast step can be open on its two extremities and, when it is in a specific position, to position the mast correctly as shown in FIG. 3A, extremity 44 can correspond to an opening 49 in beam 20, in such a way that the mast has at least one part that completely traverses the hollow housing of the mast step element 40 and that a small part, of slight length, of its extremity 50 may operate in conjunction with orifice 49 located in beam 20. In an even more preferred embodiment, extremity 50 can completely traverse beam 20, in such a way as to be able to operate, as will be explained hereinafter, particularly with reference to FIG. 4, with a tension cable of the jointed arm as illustrated and which will be described in greater detail, particularly with reference to FIGS. 5A and 5B. Of course, orifice 49 located in the beam, whether or not it is traversing, will have a watertight lining so as not to hamper flotation of the beam when it is hollow, as mentioned above.

In another preferred embodiment, the hollow recess thus located in the mast step 40 will be a recess which is cylindrical and permits mast 7 to revolve—its extremity 50 having a cross-section complementary to that of the recess—to turn about its own longitudinal axis 53, when it is positioned in its mast step 40. That advantage will be described in greater detail during description of FIG. 6A.

As mentioned above, particularly with reference to FIGS. 1 and 2, the structure also comprises two lateral arms 4 and 5. They are more specifically shown in FIG. 4 where these two lateral arms 4 and 5 are composed of a single shaft 60 in the shape of the arc of a circle and positioned to operate in conjunction with body 1, in such a way that the middle 61 of the shaft is substantially situated in proximity to the mast step 40 and its axis of rotation 41 as defined above, for example slightly forward so as not to prevent rotation of the mast step as described above.

This shaft 60 can thus be fastened in its middle 61 by bracing means 42 and 43 by any means, and in particular, for example, by a clamp fitting 69. This shaft is defined in a plane and is positioned in relation to beam 20 in such a way that a first plane containing shaft 60 and a second plane containing the axis of beam 20 are substantially perpendicular but that, in addition, its two extremities are slightly forward in relation to extremity 28 comprising the front of the boat, in such a way that an imaginary line 64 passing through the two extremities 62 and 63 of the shaft 60 is substantially tangential to the first curved part 21 of the beam, substantially in its middle 65, as shown more particularly in FIGS. 1 and 2. It is of course possible to use a shaft with a lesser radius of curvature in such a way that the imaginary line 64 passes below the curved part 21 of the beam 20. That depends essentially on details of construction.

The general shape of arc of a circle and the position of shaft 60 are particularly advantageous for connecting the pontoons as stated above, because the shocks encountered by these pontoons are transmitted to the arms, while still allowing beam 20 to undergo rotations or torsion substantially around a horizontal axis perpendicular to the second plane containing beam 20 and thus to constitute a structure that is relatively rigid but nonetheless flexible enough to absorb the energy of the shocks due particularly to waves, before that energy is transmitted to body 1 itself. Of course, to maintain a certain rigidity in shaft 60, its two extremities 62 and 63 are connected by a second tension cable 66 which is essentially contained in the second plane as defined above and connected to a number of points on shaft 60 in its median part by sub-tension cables such as 67, 68, etc.

In addition, that tension cable is positioned in such a way that it can pass below beam 20 in relation to that shaft 60 and at the level of orifice 49 traversing beam 20 in such a way that, as explained above and illustrated more particularly in FIG. 4, when mast 7 is positioned in its mast step 40, its extremity 50 of slight diameter may perhaps rest against the second tension cable 66, perhaps even deforming it as shown by a dotted line, to increase the tension on the two extremities 62 and 63, and in addition to permit shaft 60 to deform by tending to straighten, for example, due to the shocks encountered by the pontoons. In this way, the force due to shocks, which tends to straighten shaft 60, is also partially absorbed by the weight of the mast which will tend to rise but which, automatically, will return to its original position, if only because of the effect of its weight and the stress of the tension cable as mentioned above.

The two characteristics defined above, respectively the shape of shaft 60 and the position of mast 7 on tension cable 66, make a two-fold contribution to absorbing the stress on the pontoons when the boat encounters, for example, waves of a certain amplitude.

Figure 5A:
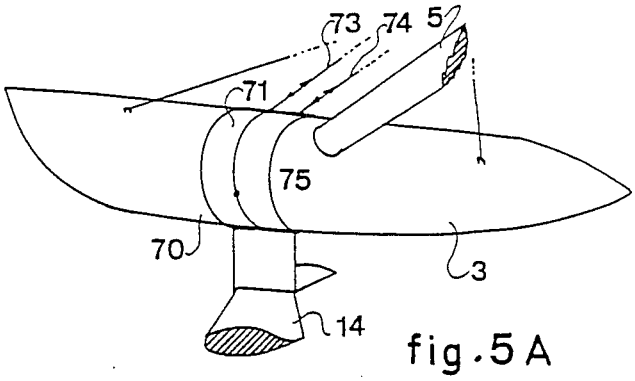
FIGS. 5A and 5B show in greater detail the pontoons as shown in the embodiment in accordance with FIGS. 1 and 2.

As mentioned above, the two lateral arms 4 and 5 support pontoons 2 and 3, respectively. FIG. 5A shows a pontoon, for example pontoon 3 connected to arm 5. This pontoon is comprised, for example, of a hollow chamber to provide flotation, but also of an external shape substantially streamlined for better penetration into the water. Such a pontoon does not have any unusual characteristics and is well known as such. However, in the framework of this preferred embodiment, its median part 70 is comprised of a cylindrical part surrounded by a sleeve 71 that supports the foil 14. This foil 14 is fixed laterally with respect to part 70 but can rotate thereabout. This foil 14 may for example be a hydrofoil or foil or fin, or other known element providing stability in the boat's progress and perhaps, in addition, improved propulsion of the boat, for example, by means of hydrofoils, to raise the entire structure as far as possible above the waves and thus limit the force of friction on the water.

Figure 5B:
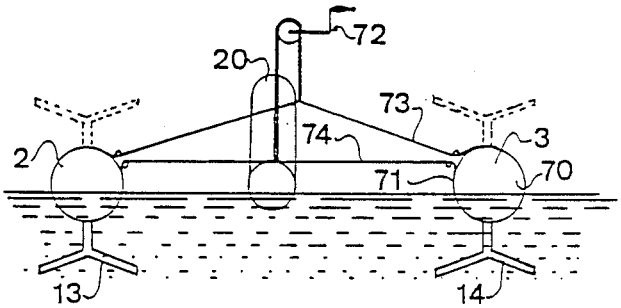

Of course, as shown in FIG. 5B, the two pontoons 2 and 3 will be symmetrical, particularly in relation to body 1, essentially beam 20. FIG. 5B shows a block diagram showing the position of the two pontoons in relation to body 1, simplified in this figure.

As mentioned above, this type of boat is essentially intended for leisure activity, more than for advanced competition. For that reason, these boats must be capable of being taken everywhere, particularly to beaches. In that case, to make such a structure easily transportable, particularly on sand, it is beneficial to be able to move or retract the foil elements or hydrofoils such as those illustrated and described in FIG. 5A, to avoid having the boat rest on the sand directly on them, and so that it rests rather on its pontoons. To allow that movement, the pivoting sleeve 71 is accompanied by at least two traction cables 73 and 74 fastened at least at one point to sleeve 71, for example, at point 75, and the two extremities are attached to said sleeve in such as way that the two cables can exercise forces of traction in two non-merging diametrical planes. In that way, by exercising a traction force on one of the two cables 73 or 74 the sleeve can be pivoted around the median part 70 of pontoon 3 and can be placed in either the lowered position as shown in solid lines in FIG. 5B (i.e., the normal position of the boat when moving through the water) or the position shown by dotted lines (i.e., the raised position to allow the pontoons to slide over or rest on a solid surface, such as sand).

Of course, these two cables 73 and 74 can be connected to two winches to obtain, as shown schematically in FIG. 5B, a single simultaneous traction on the two sleeves 71 associated with each of the pontoons and thus obtain synchronous movement of the two foil elements 13, 14, either in lowered position or in raised position. These winches shown schematically as 72 in FIG. 5B are known and pose no problem to those well versed in the art. Thus they will not be described at greater length here.

Finally, such a boat must be able to move, for example by means of sails as shown in FIG. 1. In this preferred embodiment of the invention, edge 80 of sail 8 is fastened longitudinally along mast 7. Since the mast is mounted in its mast step and can pivot around itself, the sail, instead of being lowered as in traditional sailboats, is rolled directly around the mast. To unroll it, traction need only be exercised on its extremity 81 and, in this case, the mast pivots and unrolls sail 8.

Figure 6A:
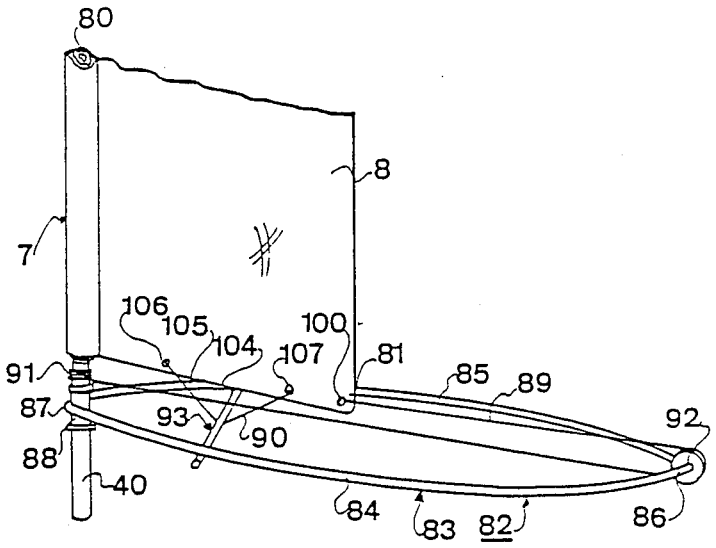
FIGS. 6A and 6B show in greater detail the elements of the mast and the sail suitable for mounting on the boat structure as shown in FIGS. 1 and 2.
Figure 6B:
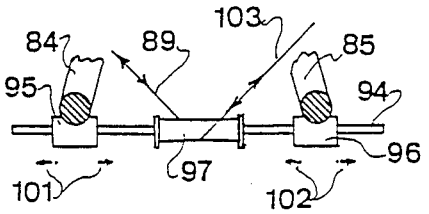

Of course, to unroll sail 8, manual traction can be exercised, for example on its extremity 81. However, in a preferred embodiment, as shown in FIGS. 6A and 6B, a boom is used in conjunction with mast 7. This boom 82 can advantageously be comprised of an element known as a wishbone 83. A wishbone is essentially made of two substantially parallel tubes 84 and 85 joined respectively at their extremities 86 and 87. Extremity 87 is able to be mounted pivotably around a secondary sleeve 88 for example, on the mast step 40. In addition, extremity 81 of sail 8 is attached to a traction cable system comprised of a cable 89 of which one extremity 90 is connected to extremity 81, passing for example through an eyelet 100, and of which the other extremity is connected to the mast, for example, in its lower part 91. This traction cable system includes different elements which are, for example, a first pulley element 92 fastened in rotation around extremity 86 of the wishbone farthest from the mast, cable 89 passing over pulley 92 and then being rolled onto the lower part 91 of the mast in a direction opposite to the one in which the sail 8 has been rolled.

In that case, assuming that sail 8 is rolled around the mast in a given direction, for example clockwise, traction can be exercised on extremity 81 by means of cable system 89 and, since it is guided around the pulley, the mast pivots in another direction, counter-clockwise in the example chosen. For that reason, the other extremity of cable 89 which is fastened at 91 on mast 7 rolls up because the direction in which it rolls up in opposite that of the sail, which thus enables cable 89 always to be relatively tight.

However, it is obvious that the elasticity of the different materials and the temperature variations cannot always provide the same length of unrolled sail and the same length of cable rolled around the lower part 91 of the mast, and vice versa. To remedy this, the cable system is accompanied by tension means 93, like those shown particularly in FIG. 6A and in more detail in FIG. 6B. These means can be comprised, in connection with a wishbone 83, of a sliding shaft 94 to which are attached two rollers 95 and 96 forming guide rollers and able to operate in cooperation respectively with the two tubes 84 and 85 forming the wishbone. These two rollers 95 and 96, in addition to their rotation, can move laterally on shaft 94, as shown by arrows 101 and 102, in such a way as to be in constant cooperation with the two lateral arms of the wishbone which are generally substantially in the shape of the arc of a circle. Between these two rollers 95 and 96 is located a guide wheel under which passes part 103 of cable 89. This wheel 97 can even be associated with a loop 105 of cable 89 which operates by sliding into eyelets 106, 107, located on the lower edge 104 of sail 8. In that way, by moving shaft 94 to a greater or lesser extent, it is possible to enlarge to a greater or lesser extent loop 105 and thus to obtain variations in the tension of cable 89 until a desired value which gives the sail the necessary tension.

So that the boat can be used safely, and taken full advantage of, it is preferable to include, from the outset or during manufacture, on its base comprising the elongated body and the lateral arms, attachment means for different navigation components, whether they are topside, rigging, or steering elements, etc. It is most beneficial to provide attachment means adapated to the elements intended to operate in conjunction with them.

Figure 7A:
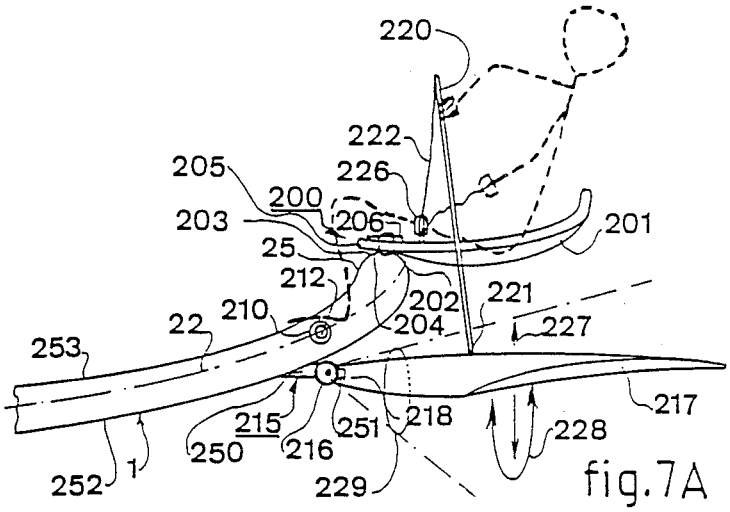
FIGS. 7A and 7B show a detail of the embodiment concerning mainly the means for steering the boat.
Figure 7B:
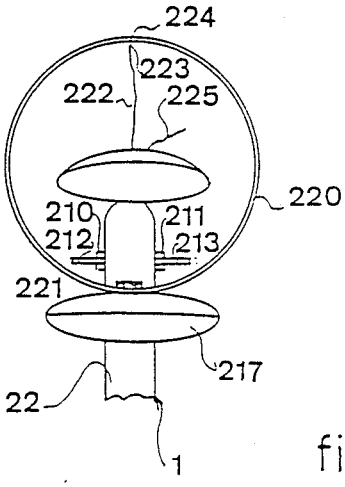

Thus, in a first embodiment as illustrated in FIGS. 7A and 7B, at the extreme rear 25 of part 22 of the elongated body 1, are included the first attachment means 200 of a seat 201 on which a potential user of such a boat can be seated. These attachment means 200 can comprise, in a preferred embodiment, a threaded part 202 which is joined by soldering to the upper extremity 203 of part 22, the threaded part 202 traversing an orifice 204, for example square, of edge 205 of seat 201. The edge 205 is thus sandwiched between the upper extremity 203 of part 22 of the elongated body 1 and, for example, a nut 206.

Seat 201 is adapted to form a slightly hollow shell so that the user of the boat can be seated properly and, in addition, be slightly supported. The rear part 25 of part 22 of elongated body 1 can thus include, on each side, at equal distance, with an average length for the legs of people likely to use such a type of boat, attachment means 210 and 211 respectively for two foot supports 212 and 213.

On that rear extremity 25 of part 22, there is also included attachment means 215, comprised for example of a projection 250 of a ball joint 216. That projection 250 is joined, for example by soldering, to extremity 25 of part 22, at a point located in proximity to seat 201, on the surface 252 of elongated body 1 opposite the one 253 on which the seat is fastened. The other projection 251 of the ball joint 216 is integral with edge 218 of a plate 217 preferably hydrodynamically streamlined.

In this way, plate 217 can assume all positions in a solid cone 229 of which the vertex is centered on the point of rotation of the ball joint 216. Because of this attachment means, in this case a projection of the ball joint 216, this streamlined plate 217 can be used for several functions: as a stabilizer for the boat and as a rudder, by tilting it in the desired directions, on one side of the line of navigation given by the longitudinal axis of body 1 and in a non-horizontal plane. These two movements are shown, for stabilization, by the movements according to arrow 227, and for the rotations in the oblique planes on either side of the elongated body 1, by arrow 228.

This plate thus beneficially replaces the rudder as briefly described and referred to as 26 and 27 above in connection with FIG. 3A.

However, in this embodiment, it is beneficial for the user, when he is seated on seat 201, to be able to control or place the plate in the necessary position and orientation when his boat moves through the water. A preferred means to control the position and orientation of plate 217 is comprised of a circular ring 220 substantially joined at at least one point 221 of plate 217, substantially in its middle. This ring has a radius sufficient for it to be able to surround the seat and the person when he is sitting on the seat, for all possible positions of plate 217, as stabiliser or as rudder, when it is moved in its solid cone mentioned above.

In addition, to control plate 217 more easily by acting on the circular ring, the structure comprises a line fastened at one of its extremities 223 at a point 224 substantially diametrically opposite to the point 221 on which is fastened plate 217, the other extremity 225 of this line 222 passing through a pulley 226 fastened in front of seat 201, substantially at the level of the fastening means 200 in such a way that the user can, as easily as possible, exercise traction on this line 222 which is within his reach.

It will thus be seen that a user navigating with such a boat structure, seated on seat 201, can control the plate to make it act either as a stabiliser, by plunging it into the water to a greater or lesser degree according to arrow 227 or by exercising more or less strong traction on extremity 225 of line 222, or as rudder, by turning ring 220 simultaneously to the tractions on line 222, to shift the plate to one side or the other and to orient it in a plane oblique in relation to the longitudinal axis of elongated body 1.

Figure 8:
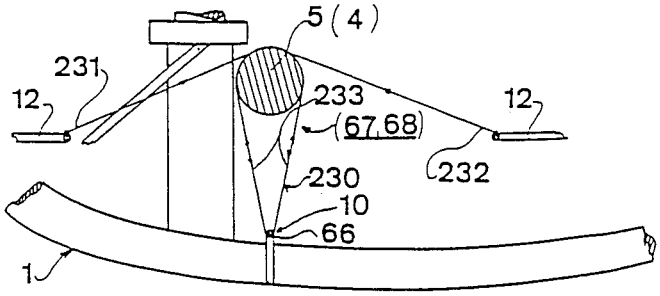
FIG. 8 shows a detail of the embodiment of another characteristic in accordance with the present invention, to permit better distribution of stress during navigation on a surface comprising, for example, waves.
Figure 9:
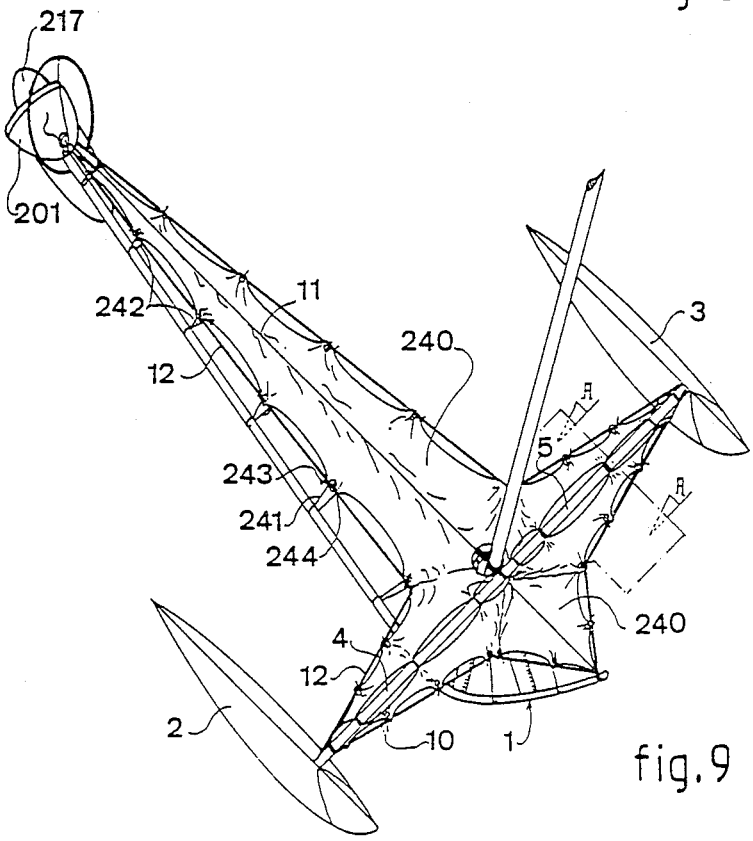
FIG. 9 represents a final detail of the embodiment of an additional characteristic permitting the beneficial increase of the usable deck surface of such a boat, in accordance with said invention.

In what has just been written, attachment means have been provided in the case of operation with a seat, a rudder, and foot supports. However, in a preferred embodiment, it has been stated that, in particular, arms 4 and 5 could be comprised of beams of the general shape of cylindrical of revolution. The shape of the cross-section of these arms is illustrated in FIG. 8 which is a simplified cross-section along the plane referred to as A—A in FIG. 9, which represents the general appearance of the boat structure in accordance with the invention.

In this case, the circular shape of arm 5 enables its external surface to act as an attachment in the form of a pulley particularly for sub-tension cables 67, 68 like those that are linked to the tension cables 12 and 66. In a preferred embodiment, the tension cable 12 going around the extremities of the boat structure and the tension cable 66 linking the distant extremities of the two arms 4 and 5, are linked by means of sub-tension cables 230 of which one of the extremities 231 is fastened to the portion of cable 12 passing substantially on one side of arm 5 (or 4), and of which the other extremity 232 is fastened to the other portion of the tension cable 12 located on the other side of arm 5, that sub-tension cable 230 having enclosed in a complete free loop 233, both the beam of arm 5 and the tension cable 66 linking the two extremities of the two arms. This attachment means is easy to provide, and makes it possible in addition to leave tension cable 66 free to slide in relation to the sub-tension cable which links it to the two arms.

For that reason, when one of the pontoons 2 or 3 is subjected to a significant shock, for example due to impact with a wave, and the arms tend to deform, the tension cable 66 can thus slide into the inside of the loops 233 of the sub-tension cables located along the entire length of these arms to distribute in this way the stress along the length of the arms and on all of the sub-tension cables instead of having this stress be absorbed only by the first sub-tension cables that are closest to the pontoon having undergone the shock.

Finally, in such a structure, there can be included attachment means on the body, like the central beam or the arms, as well as on the tension cables 10, 11, 12, in order, for example, to tighten the fabric, to increase the "deck" surface of the structure. That increase in surface, thanks to fabric 240, has at least two advantages: on the one hand, allowing the user to move about for various reasons on the structure, for example to attach the sails, tighten the rigging, etc., and on the other hand to protect him from spray, etc.

All of this fabric 240 is stretched and hooked between the different portions of the tension cable 12 and passes, for example, above tension cable 11 to be attached, on one extremity, close to seat 201 and, on the other extremity, on arms 4 and 5. The front of this structure can comprise, as well, fabric 240 stretched between these two same arms 4 and 5 and the portions of tension cable 12 that are connected to the front of elongated body 1.

These attachment means can be, in a preferred embodiment, extremities 241 of sub-tension cables 242 located and distributed along the entire length of the central beam and of arms 4 and 5, in association with tension cables 10, 11, 12. These extremities 241 comprise hooks 243 passing through eyelets 244 located in the edge of fabric 240. These makes it possible to attach and stretch the fabric, for example between the two portions of tension cable 12 located on either side of the median line of the boat structure.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims:

I claim:

1. A boat structure, comprising an elongated central body, two pontoons, two longitudinal lateral arms of which a first of their extremities is integral with said body by first attachment means and two second and third linking means of the two other second extremities of said arms being attached to said two pontoons, respectively, wherein said body is comprised of a beam comprising two parts abutting one against the other along a junction surface, a first relatively short part substantially in the shape of the arc of a circle with a first value R1 for the radius of curvature, a second part longer than the first part, in the shape substantially of the arc of a circle with a second value R2 for the radius of curvature significantly greater than the first value R1, and a first tension cable connecting a first and second extremities of said beam.

2. The structure in accordance with claim 1, wherein the cross section of said beam is substantially in the shape of a circle.

3. The structure in accordance with claim 1, wherein said beam is hollow.

4. The structure in accordance with claim 1 wherein it comprises a tension cable connecting successively the first extremity of said beam to a second extremity of a first arm, the latter to the second extremity of the beam, the latter to a second extremity of the second arm and finally, the latter once again to the first extremity of the beam.

5. A boat structure comprising an elongated central body, two pontoons, two longitudinal arms of which a first of their extremities is integral with said body by first attachment means and two second and third linking means of the two other second extremities of said arms being attached to the two said pontoons, respectively, wherein said body is comprised of a beam comprising two parts abutting one against the other along a junction surface, a first relatively short part substantially in the shape of the arc of a circle with a first value R1 for the radius of curvature, a second part longer than the first part, in the shape substantially of the arc of a circle with a second value R2 for the radius of curvature significantly greater than the first value R1, the two said arms are composed of a two part curved shaft situated in a first plane substantially perpendicular to a second plane containing said beam, said first plane passing in the vicinity of said junction surface of the two said parts, the lengths of the two parts of said shaft situated on either side of said second plane being substantially equal, the two said parts of said shaft forming the two said arms.

6. The structure in accordance with claim 5, wherein said first attachment means comprises means for bracing situated between said beam and said shaft.

7. The structure in accordance with claim 5, wherein said shaft is formed in such a way that a line passing substantially by the two furthest extremities of said shaft will be at least one of the following:

substantially tangential to said first part of the beam in the shape of the arc of a circle; and passing under said first part of the beam, substantially in its middle.

8. The structure in accordance with claim 5 comprising a second tension cable, connecting substantially the two extremities of said shaft.

9. The structure in accordance with claim 8, wherein said second tension cable passes under said beam in relation to said shaft.

10. The structure in accordance with claim 8, comprising a mast step pivoting in said second plane about an axis located substantially in proximity to said shaft, and means for locking said mast step in a specific position in relation to said beam.

11. The structure in accordance with claim 10, wherein said mast step is composed of a portion of tube comprising a hollow recess open at an extremity and capable of receiving an extremity of a mast for sails.

12. The structure in accordance with claim 11, wherein said recess is open on its two extremities and wherein said beam comprises an orifice traversing a section above that of the extremity of said mast and located in the axis of said recess when said portion of the tube is locked in said specific position, said second tension cable passing substantially in the axis of said orifice, in such a way as to form a stop for the extremity of said mast suitable for being placed in said recess.

13. The structure in accordance with claim 11, wherein said recess is circular to permit rotation of said mast of which the extremity is pivotally mounted in said recess.

14. The structure in accordance with claim 11, comprising a boom capable of turning in a plane substantially perpendicular to said portion of tube and means for pivotally mounting said boom on said portion of tube.

15. The structure in accordance with claim 14, comprising a sail mounted on said mast and a traction cable system of which one extremity is integral with said sail and of which the other extremity is rolled on said mast in a direction opposite to that in which said sail can be rolled, said traction cable system comprising at least one pulley located on said boom at a point distant from said mast, said traction cable system passing over said pulley, and means for tensioning said traction cable system.

16. The structure in accordance with claim 15, wherein the means for tensioning comprises, said boom which is at least two shafts forming means for guiding, and of means for rolling being cable of operating in conjunction with said means for guiding to move by rolling along said shafts, said traction cable system being linked to said means for rolling for exerting necessary traction on the cable system as a function of their position on said shafts.

17. A boat structure comprising an elongated central body, two pontoons, two longitudinal lateral arms of which a first of their extremities is integral with said body by first attachment means and two second and third linking means of the two other second extremities of said arms being attached to the two said pontoons, respectively, wherein said body is comprised of a beam comprising two parts abutting one against the other along a junction surface, a first relatively short part substantially in the shape of the arc of a circle with a first value R1 for the radius of curvature, a second part longer than the first part, in the shape substantially of the arc of a circle with a second value R2 for the radius of curvature significantly greater than the first value R1, said pontoons are made of a first body comprising at least one median portion substantially cylindrical, a sleeve located on said median portion with a cross-section substantially complementary to that of said median portion in such a way as to be able to pivot around said median portion, foils mounted to operate in conjunction with said sleeve and means for controlling the pivoting of said sleeve.

18. The structure in accordance with claim 17, wherein said foils are comprised of at least one of the following elements: hydrofoil, fin, and rudder

19. The structure in accordance with claim 17, wherein the means for controlling the pivoting of said sleeve are comprised of at least two traction cables of which one of their respective extremities is fastened on said sleeve and of which application of their forces affects two points located in two diametrically different planes of said sleeve, and means for exerting traction respectively on the two other extremities of said two traction cables.

20. A boat structure comprising an elongated central body, two pontoons, two longitudinal lateral arms of which a first of their extremities is integral with said body by first attachment means and two second and third linking means of the two other second extremities of said arms being attached to the two said pontoons, respectively, wherein said body is comprised of a beam comprising two parts abutting one against the other along a junction surface, a first relatively short part substantially in the shape of the arc of a circle with a first value R1 for the radius of curvature, a second part longer than the first part, in the shape substantially of the arc of a circle with a second value R2 for the radius of curvature significantly greater than the first value R1, and wherein preplaced means for attaching navigation components and at least one navigation element operating in conjunction with said means for attaching are provided in association with at least one of said central elongated body and said two arms.

21. The structure in accordance with claim 20, wherein said navigation element comprises a seat for a potential user, and where said preplaced means for attaching navigation components comprises at least one shaft that is integral with the rear extremity of said elongated body and being capable of holding at least the thickness of said seat.

22. The structure in accordance with claim 21, wherein said navigation element comprises foot supports operating in conjunction with the means for attaching navigation components preplaced on the rear part of said elongated body, in proximity to said seat and at a distance substantially equal to a length of a leg of a potential user.

23. The structure in accordance with claim 21, wherein said navigation element is comprised of a rudder in the form of a streamlined plate and wherein said preplaced means for attaching are composed of at least a first projection of a ball joint with two first and second projections, the first projection being integral with said rear part of said elongated body, the second projection being integral with an edge of said streamlined plate.

24. The structure in accordance with claim 23, wherein said first projection of the ball joint is located in proximity to said seat, substantially on the surface of the elongated body opposite that surface on which said seat is attached.

25. The structure in accordance with claim 24, comprising means for controlling positioning of said plate.

26. The structure in accordance with claim 25, wherein said means for controlling said plate comprise at least one ring linked at least at one first point to said plate and being capable of surrounding said seat.

27. The structure in accordance with claim 26, wherein said means for controlling said plate additionally comprise a line fastened at a second point on the ring, substantially diametrically opposite said first point, said line passing through a pulley fastened substantially in front of said seat.

28. The structure in accordance with claim 20, wherein said means for attaching are made of at least one tension cable operating in conjunction with at least one of said elongated body and said two arms and a fabric piece, and wherein said means for attaching are comprised of portions of sub-tension cables connecting one of said tension cable, elongated body and two arms, with edges of said fabric piece.

* * * * *